United States Patent [19]

Herrig

[11] Patent Number: 4,669,344

[45] Date of Patent: Jun. 2, 1987

[54] METHOD AND APPARATUS FOR SUBDIVIDING WEBS OF COHERENT PAPER SHEETS

[75] Inventor: Friedhelm Herrig, Hamburg, Fed. Rep. of Germany

[73] Assignee: E.C.H. Will (GmbH & Co.), Hamburg, Fed. Rep. of Germany

[21] Appl. No.: 853,719

[22] Filed: Apr. 18, 1986

[30] Foreign Application Priority Data

Apr. 20, 1985 [DE] Fed. Rep. of Germany ..... 3514389

[51] Int. Cl.[4] ..... B26D 5/32

[52] U.S. Cl. ..... 83/27; 83/37; 83/72; 83/76; 83/80; 83/104

[58] Field of Search ..... 83/27, 37, 72, 76, 80, 83/104

[56] References Cited

U.S. PATENT DOCUMENTS 3,276,647 10/1966 Lewis, Jr. et al. ..... 83/76 X
4,201,102 5/1980 Rudszinat ..... 83/298
4,211,132 7/1980 Nichols, III et al. ..... 83/80 X
4,255,998 3/1981 Rudszinat ..... 83/298

FOREIGN PATENT DOCUMENTS 3409548 10/1984 Fed. Rep. of Germany .

*Primary Examiner*—James M. Meister
*Attorney, Agent, or Firm*—Peter K. Kontler

[57] ABSTRACT

Successive watermarks on a running web of coherent paper sheets are monitored by a scanner which generates defect signals in response to detection of watermarks outside of selected portions of the respective sheets, and the cross cutter which severs the web to form discrete sheets is then adjusted to separate the respective sheets from the next-following sheets with a delay or prematurely so that the sheets bearing the improperly positioned watermarks are too short or too long. Such defective sheets are segregated from satisfactory sheets downstream of the cross cutter in properly delayed response to generation of defect signals by the scanner.

19 Claims, 1 Drawing Figure

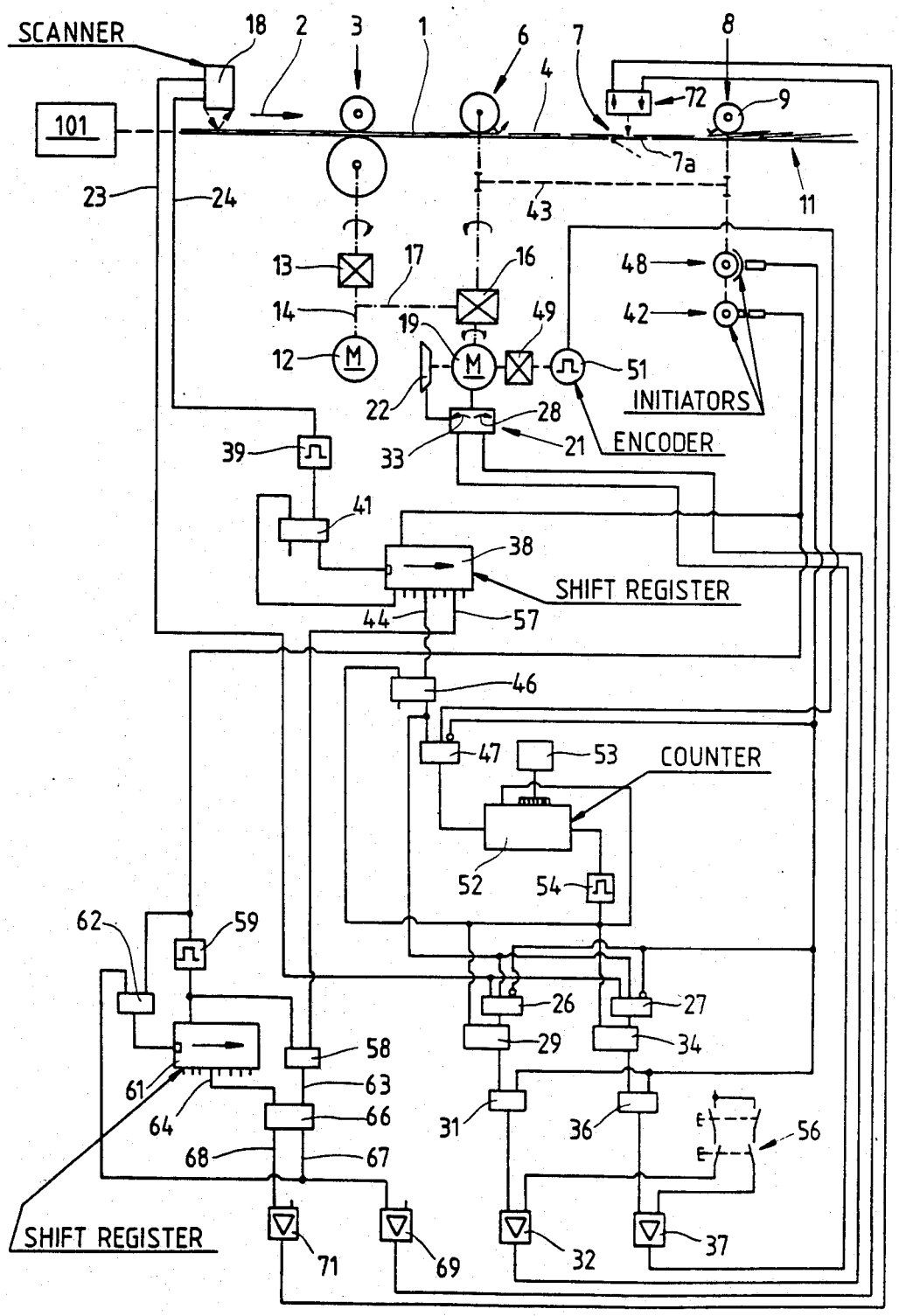
SCANNER
101
INITIATORS
ENCODER
SHIFT REGISTER
COUNTER
SHIFT REGISTER

METHOD AND APPARATUS FOR SUBDIVIDING WEBS OF COHERENT PAPER SHEETS

BACKGROUND OF THE INVENTION

The present invention relates to a method of and to an apparatus for classifying sheets according to the positions of indicia which are provided on the sheets, particularly for classifying paper sheets in dependency on the positions of watermarks and/or other types of impressed and/or imprinted indicia relative to one or more selected edges of the sheets.

It is well known to provide better-quality paper sheets with watermarks. Such indicia should be located at a fixed distance from the tops and/or bottoms and/or lateral edges of the respective sheets. Watermarks are provided in the sheets before a larger panel of coherent sheets is subdivided into sheets of unit length and width. It is desirable to ensure that each watermark occupy a predetermined position relative to the edges of the respective sheet and, therefore, those sheets whose watermarks are improperly positioned are segregated from other sheets when the positions of watermarks deviate from a preselected range of acceptable positions, i.e., when the watermarks are located outside of selected portions of the respective sheets.

In accordance with a presently known proposal, a roll of paper is first subdivided into large panels each of which contains several sheets, and such large panels are subdivided into sheets of unit length in a guillotine type cutter. Orientation of the panels is effected by hand so as to ensure that the watermarks are located at desired distances from the edges. Such operation is cumbersome, slow and unreliable.

Another known proposal involves scanning individual sheets and discarding those wherein the watermarks are outside of an acceptable field.

OBJECTS AND SUMMARY OF THE INVENTION

An object of the invention is to provide a novel and improved method of segregating from a series of freshly formed still unstacked sheets those sheets whose indicia are misplaced.

Another object of the invention is to provide a novel and improved method of classifying freshly severed paper sheets according to the positions of their watermarks.

A further object of the invention is to provide a novel and improved automatic method of classifying moving coherent paper sheets according to the positions of watermarks relative to their edges.

An additional object of the invention is to provide a novel and improved apparatus for the practice of the above outlined method and to construct and assemble the apparatus in such a way that it can automatically segregate sheets having improperly positioned indicia from other sheets.

A further object of the invention is to provide an apparatus which can segregate satisfactory sheets from defective sheets or from groups of sheets including one or more defective sheets.

Still another object of the invention is to provide the apparatus with novel and improved means for controlling the operation of means for subdividing a web of randomly distributed coherent satisfactory and defective sheets.

One feature of the present invention resides in the provision of a method of classifying sheets according to the positions of indicia which are provided thereon, particularly according to the positions of watermarks with reference to selected edges of paper sheets. The method comprises the steps of conveying a series of coherent sheets (e.g., a continuous paper web) in a predetermined direction along a predetermined path, severing successive foremost sheets from the series of coherent sheets at a first location adjacent the predetermined path so that the length of the thus obtained discrete sheets normally matches a predetermined value, monitoring the distance of indicia on successive coherent sheets from the first location at a second location which is preferably disposed at a fixed distance from the first location, comparing the monitored distance with a range of acceptable distances, generating a signal when the monitored distance is outside of the range of acceptable distances, utilizing the signal to sever the corresponding sheet in such a way that the length of the severed (defective) sheet deviates from the predetermined value, and expelling the defective sheet from the path.

The utilizing step can include changing the timing of severing the defective sheet from the series of coherent sheets in dependency on the distance of the corresponding indicium from the first location so that the length of the defective sheet exceeds or is less than the predetermined value, depending upon the (upward or downward) deviation of the monitored distance from the range of acceptable distances. The sheet carrying the improperly positioned indicium will be too long if the position of the indicium is ahead of its anticipated position, and the sheet will be too short if the respective indicium is behind its anticipated position, as considered in the direction of travel of the series of coherent sheets.

Another feature of the invention resides in the provision of an apparatus for classifying sheets according to the positions of indicia which are provided thereon, particularly according to the positions of watermarks with reference to selected edges of paper sheets. The apparatus comprises a source of a web of coherent sheets (such source can constitute a bobbin for storage of a convoluted web of coherent paper sheets), driven rolls or other suitable means for advancing the web from the source in a predetermined direction along a predetermined path, adjustable means for severing the web at a first location adjacent the predetermined path (such severing means can comprise a cross cutter with a rotor for one or more knives which can be orbited at a higher or lower speed), a scanner including means for monitoring the distance of successive indicia from the location of the severing means at a second location which is disposed upstream of the first location, for comparing the monitored distance with a range of acceptable distances and for generating defect signals when the monitored distance is outside of the range of acceptable distances, means for adjusting the severing means in response to defect signals so that the length of the corresponding (defective) sheets deviates from the predetermined value, and means for expelling defective sheets from the path. The adjusting means can comprise means for changing the timing of severing the web by the cross cutter of the severing means. The presently preferred cross cutter comprises the aforementioned rotor and means (e.g., one or more transmissions driven by a first d-c motor) for imparting to the rotor a first rotary movement, and the adjusting means can comprise a second d-c motor which can impart to the rotor a second rotary movement superimposed upon the first rotary movement so that the resulting rotary movement deviates from (it is faster or slower than) the first movement. The second motor can constitute a reversible motor which can accelerate or decelerate the means for imparting the first rotary movement (such means can comprise a differential transmission of conventional design).

The first and second locations are preferably disposed at a fixed distance from each other, and such fixed distance can equal $m \times n + \frac{1}{2}n$ wherein m is a whole number and n is the aforementioned predetermined value.

The apparatus further comprises means for transmitting signals from the signal generating means of the scanner to the expelling means in imitation of travel of the corresponding defective sheets from the scanner to the expelling means. Such signal transmitting means can include or form part of the means for transmitting signals from the scanner to the means for adjusting the severing means and can comprise one or more shift registers or other suitable time-delay devices.

Still further, the apparatus preferably comprises means for preventing an adjustment of the severing means during actual severing of the web. Such preventing means can comprise one or more initiators which are operated in synchronism with the severing means so as to generate signals when the severing means is in the process of severing the web; these signals are used to prevent an adjustment of the speed of the rotor of the severing means during the corresponding stage of angular movement of the rotor. The synchronizing means can comprise a mechanical or other suitable connection which is provided between the severing means and the initiator or initiators to ensure that the initiator or initiators transmit signals at the frequency at which the severing means severs the web.

The means for transmitting signals to the expelling means can be designed in such a way that the expelling means segregates the defective sheets as well as one or more additional sheets if the expulsion of one or more additional (satisfactory) sheets is desirable or necessary, e.g., to ensure that the satisfactory sheets can be assembled into a stream of partially overlapping sheets.

The means for transmitting signals from the scanner to the adjusting means can comprise a counter which serves to determine the extent to which the angular position of the rotor of the cross cutter is changed preparatory to severing a defective sheet, i.e., to select the extent to which the angular position of the rotor must be changed with reference to that position which the rotor assumes for the severing of satisfactory sheets.

Means can be provided for resetting the severing means to a predetermined starting position, particularly upon replacement of a first source with a second source. Such resetting means can comprise a manually operable switch which can be actuated to transmit signals to the adjusting means, e.g., by way of one or more operational amplifiers.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a diagrammatic view of a circuit arrangement which is embodied in the improved apparatus and controls the operation of means for subdividing a web of randomly distributed coherent satisfactory and defective sheets as well as the means for segregating defective sheets from satisfactory sheets.

DESCRIPTION OF THE PREFERRED EMBODIMENTS

The reference character 1 denotes a running web which constitutes a series of randomly distributed coherent satisfactory and defective paper sheets 4. The web 1 is advanced along an elongated path in the direction of arrow 2 by advancing or conveying means 3 including two rollers one of which is driven by a d-c motor 12 through the medium of a transmission 13 corresponding to U.S. Pat. No. 4,548,404. The power train between the motor 12 and the transmission 13 is indicated by the phantom line 14.

Each sheet 4 is provided with an indicium, particularly a watermark, and the positions of watermarks with reference to one or more edges of defective sheets are different from the positions of watermarks with reference to one or more edges of acceptable or satisfactory sheets 4. The means for subdividing the web 1 into a series of discrete sheets 4 comprises a cross cutter 6 whose rotor can be driven at any one of a number of different speeds by a conventional differential transmission 16 which is normally driven only by the d-c motor 12 by way of the power train 14 and an additional power train 17 so that the frequency at which the orbiting knife of the cross cutter 6 severs the web 1 is synchronized with the speed of the rollers forming part of the advancing means 3. The cross cutter 6 is followed by an expelling or segregating device 7 which serves to induce defective sheets 4 to leave the path of satisfactory sheets, and by a further processing station 8 accommodating a scalloping unit 9 wherein successive satisfactory sheets 4 are caused to partially overlie each other so as to form a stream 11 which is ready to be advanced to a stacking device or to another processing station. Reference may be had to the commonly owned German Offenlegungsschrift No. 34 09 548.

The power train 17 establishes a mechanical connection between the power train 14 and the transmission 16 which latter drives the rotor of the cross cutter 6 at a selected speed. The cross cutter 6 may be of the type disclosed in U.S. Pat. Nos. 4,201,102 and 4,255,998 to Rudszinat. The disclosures of these patents are incorporated herein by reference.

The means for monitoring the web 1 of coherent satisfactory and defective sheets 4 for the positions of watermarks comprises a scanner 18 which is disposed upstream of the cross cutter 6 at a fixed distance from the latter and may be of the type offered by Norcan Ltd. of Great Britain. The scanner 18 comprises means for monitoring the distance of successive watermarks from the location of the cross cutter 6, means for comparing the detected distance with a range of acceptable distances, and means for generating signals, at least when the monitored distance deviates from the acceptable range. Such signals are transmitted to an adjusting unit or control unit 21 for a reversible d-c motor 19 which can superimpose upon the rotational movement of the output element of the differential gearing 16 a second movement in dependency on the extent and direction of deviation of the distance of a particular watermark from the range of acceptable distances. Thus, the output element of the transmission 16 can be accelerated or decelerated so as to change the timing of severing of web 4 by the knife of the cross cutter 6 so that the length of the thus separated (defective) sheet deviates from a predetermined standard value, namely from the length of a satisfactory sheet 4.

When the scanner 18 fails to generate a defect signal which is indicative of a defective sheet 4 (i.e., of an unsatisfactory distance of a watermark from the location of the cross cutter 6), the differential transmission 16 is driven solely by the motor 12 for the transmission 13, and the motor 19 is ineffective. At such time, the rotary part or parts of the motor 19 are engaged by a brake 22 which is also controlled by the adjusting unit 21.

The segregating device 7 can comprise a simple pivotable deflector in the form of a gate or flap 7a which can divert an overly short or an overly long sheet from the path along which satisfactory sheets 4 advance to the station 8. The means for transmitting signals from the signal generating unit of the scanner 18 to start the operation of the d-c motor 19 is denoted by the line 23, and the means for transmitting to the adjusting unit 21 signals denoting the direction of adjustment of the cross cutter 6 (to sever a sheet which is too long or too short) is denoted by the line 24.

The signal transmitting means 23 comprises two AND gates 26, 27 one of which receives the defect signal when the watermark which has initiated the generation of such signal is too distant from the location of the cutter 6 and the other of which receives the defect signal in response to detection of a watermark which is too close to the location of the cutter 6. When the AND gate 26 transmits a signal to the corresponding input of the adjusting unit 21 by way of a flip flop 29, an AND gate 31 and an operational amplifier 32, the motor 19 is started in one direction (note the arrow 28 in the box denoting the adjusting unit 21). The arrow 33 denotes the direction in which the motor 19 is started by the adjusting unit 21 when the corresponding input of the unit 21 receives a signal from the AND gate 27 by way of a flip-flop 34, an AND gate 36 and an operational amplifier 37.

The cross cutter 6 should not be accelerated or decelerated while it is in the process of severing the web 1 because this could damage the web. Furthermore, the defect signal which is generated by the scanner 18 should be properly delayed so that it reaches the adjusting unit 21 and effects segregation of the defective sheet 4 from the next-following sheets of the web 1 after the watermark whose detection resulted in the generation of a defect signal has advanced beyond the cutting location. In other words, a defect signal must be transported from the scanner 18 to the adjusting unit 21 in imitation of advancement of the respective watermark from the monitoring station to the severing location.

The monitoring station is located at a fixed distance from the cross cutter 6. Such distance is several times the length of a satisfactory sheet 4 plus one-half the length of a satisfactory sheet, i.e., $m.n+\frac{1}{2}n$ wherein m is a whole number and n is the aforementioned predetermined value (i.e., the length of a satisfactory sheet 4).

The signal transmitting means 24 comprises a shift register 38 or an analogous time-delay unit connected with the output of the signal generating means of the scanner 18 by a monoflop 39 which generates an impulse for transmission to the input of the shift register 38 in response to the generation of a defect signal by the scanner 18. The connection between the monoflop 39 and the corresponding input of the shift register 38 comprises a flip-flop 41. Another input of the shift register 38 is connected with an initiator 42 which transmits signal transporting pulses at the rate of one per each cut across the web 1. The operative (e.g., mechanical) connection between the cross cutter 6 and the initiator 42 is denoted by a phantom line 43; this connection ensures that the ratio of the frequency of severing the web 1 by the orbiting knife of the cutter 6 and the frequency at which the initiator 42 transmits pulses to the shift register 38 is one-to-one.

An output 44 of the shift register 38 transmits signals to a flip-flop 46 whose output is connected with the corresponding inputs of the aforementioned AND gates 26 and 27. Thus, the gate 26 or 27 transmits a signal to the corresponding flip-flop 29 or 34 when each of its heretofore mentioned inputs receives a signal, namely from the flip-flop 46 and from the scanner 18 via signal transmitting means 23. The output of the flip-flop 46 is further connected to one input of an AND gate 47 whose other input is connected to a second initiator 48 and whose output is connected with one input of a signal counter 52.

The initiator 48 transmits signals in synchronism with the operation of the cross cutter 6 (note the connection 43) and is connected with the AND gate 47 as well as with the AND gates 26, 27, 31 and 36. The purpose of the initiator 48 is to generate signals which denote those intervals when the rotor of the cross cutter 6 is in the process of severing the web 1, i.e., when the speed of the rotor should not be changed by the adjusting unit 21.

When the motor 19 is in operation, it drives an encoder 51 by way of a transmission 49, and the encoder 51 then transmits to the corresponding input of the AND gate 47 a series of signals each of which is indicative of a predetermined distance covered by the orbiting knife of the rotor in the cutter 6, e.g., a distance of 0.5 mm. The signal at the output of the counter 52, which is connected to the output of the AND gate 47, determines the extent of angular adjustment of the rotor of the cross cutter 6, and the range of corrections can be selected by a so-called thumb wheel switch 53 or any other suitable counter setting device. The range can also be determined by the controls of the machine which embodies the improved apparatus. The output of the counter 52 is connected with the flip-flops 29, 34 and 46 by a monoflop 54.

In order to enable the attendant to reset the cross cutter 6 to a predetermined starting position, e.g., when the source 101 (normally a roll) of coherent sheets 4 is replaced by a fresh source, the apparatus comprises a manually operable switch 56 connected with the operational amplifiers 32 and 37 whose outputs then transmit signals serving to activate the adjusting unit 21. The switch 56 enables an attendant to properly set the cross cutter 6 preparatory to making of the first cut across the leader of a fresh web 1 so that the watermark on the foremost sheet will be located at a proper distance from the front and rear (top and bottom) edges of the foremost sheet.

The activation of segregating device 7 is delayed until a defective (too short or too long) sheet reaches the respective portion of the path for satisfactory sheets 4 which are on their way toward the station 8. The defect signals from the signal generating means of the scanner 18 to the valves 72 for the flap 7a of the segregating device 7 are delayed by the aforementioned shift register 38 whose output 57 transmits signals to an AND gate 58. The output 63 of the gate 58 transmits signals to a flip-flop 66. Transmission of signals from the AND gate 58 to the valves 72 is synchronized with the transmission of signals by the initiator 42. To this end, the output of the initiator 42 is connected with a monoflop 59 whose output is connected with the corresponding input of the AND gate 58 as well as with one input of a shift register 61. The initiator 42 is connected with a second input of the shift register 61 by an AND gate 62. The shift register 61 (which can be replaced with another suitable time-delay device) determines the number of sheets which are to be expelled in response to a defect signal from the AND gate 58. Ejection of several sheets is often necessary because the manner of scalloping the stream 11 may be such that a resumption of the formation of an acceptable stream 11 is possible only if the segregating device 7 diverts more than a single sheet (e.g., a total of four sheets including the defective sheet). The shift register 61 may comprise means for displaying the number of sheets which are expelled in response to each activation of the segregating device 7.

The flip-flop 66 is connected with the output 63 of the AND gate 58 as well as with the output 64 of the shift register 61. This flip-flop has a first output 67 which transmits signals for actuation of the segregating device 7 in response to detection of an improperly located watermark by the scanner 18 and a second output 68 which transmits signals for deactivation of the device 7 when the latter has completed the diversion of a predetermined number of sheets 4. The outputs 67 and 68 respectively transmit signals via operational amplifiers 69 and 71 which are connected with the corresponding inputs of the valves 72. These valves can control a reversible fluid-operated motor which moves the flap 7a of the segregating device 7 between a first position (shown by solid lines) in which the device 7 is inactive and a second position (indicated by broken lines) in which the device 7 causes the oncoming sheets to leave the path leading toward the station 8.

The various elements of the circuit which is shown in the drawing are commercially available parts. The same applies for the connections 14, 17, 43, transmissions 13, 16, 49 and motors 12, 19.

An important advantage of the improved method and apparatus is that an improperly positioned watermark is detected and the corresponding defective sheet is segregated from acceptable sheets prior to stacking of the defective sheet with satisfactory sheets and/or prior to introduction of the defective sheet into the stream 11. This is accomplished by properly delaying the defect signals which are generated by the scanner 18 so that the signals can effect timely acceleration or deceleration of the rotor of the cross cutter 6 as well as timely opening of the gate 7a.

The differential transmission 16 can be of the type known as PE - BII - 3/1 manufactured by Tandler, the control unit 21 and its motor 19 can be of the type marketed by Contraves (servomotor ACR-072-0-0-C-4-CS1/T), the initiators 42 and 48 may be of the type NJ5 - 18 GM E2 factured by Teppel & Fuchs, the counter 52 can be a forward-backward counter of the type 6 EC2 350-0A manufactured by Siemens, and the switch 53 can be of the type 6 EC2 491-0A manufactured by Siemens.

Certain features of the apparatus of the present invention are disclosed in the aforementioned commonly owned U.S. Pat. No. 4,548,404.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of classifying sheets according to the positions of indicia which are provided thereon, particularly according to the positions of watermarks with reference to selected edges of paper sheets, comprising the steps of conveying a series of coherent sheets in a predetermined direction along a predetermined path; severing successive foremost sheets from said series at a first location adjacent said path so that the length of the thus obtained discrete sheets normally matches a predetermined value; monitoring the distance of indicia on successive coherent sheets from the first location at a second location which is disposed at a fixed distance from the first location; comparing the monitored distance with a range of acceptable distances; generating a signal when the monitored distance is outside of said range; utilizing the signal to sever a corresponding defective sheet in such a way that the length of the severed defective sheet deviates from said value; and expelling the defective sheet from said path.

2. The method of claim 1, wherein said utilizing step includes changing the timing of severing the defective sheet from the series of coherent sheets in dependency on the distance of the corresponding indicium from the first location so that the length of the defective sheet exceeds or is less than said value, depending on the upward or downward deviation of the monitored distance from said range.

3. Apparatus for classifying sheets according to the positions of indicia which are provided thereon, particularly according to the positions of watermarks with reference to selected edges of paper sheets, comprising a source of a web of coherent sheets; means for advancing the web from said source in a predetermined direction along a predetermined path; adjustable means for severing the web at a first location adjacent to said path so that the length of the thus obtained descrete sheets normally matches a predetermined value; a scanner including means for monitoring the distance of successive indicia from said location at a second location upstream of said first location, means for comparing the monitored distance with a range of acceptable distances, and means for generating signals when the monitored distance is outside of said range; means for adjusting said severing means in response to said signals so that the length of the corresponding defective sheets deviates from said value; and means for expelling defective sheets from said path.

4. The apparatus of claim 3, wherein said severing means comprises a rotary cross cutter and said adjusting means includes means for changing the timing of severing the web by the cross cutter.

5. The apparatus of claim 4, wherein said cross cutter comprises a rotor and means for imparting to said rotor a first rotary movement, said adjusting means including motor means for imparting to said rotor a second rotary movement which is superimposed upon the first movement so that the resulting rotary movement deviates from said first movement.

6. The apparatus of claim 5, wherein said motor means includes a reversible motor which can accelerate or decelerate said means for imparting said first rotary movement.

7. The apparatus of claim 6, wherein the means for imparting said first rotary movement includes a differential transmission.

8. The apparatus of claim 3, wherein said first and second locations are disposed at a fixed distance from each other, as considered in said direction.

9. The apparatus of claim 8, wherein said fixed distance equals $m \times n + \frac{1}{2}n$ wherein m is a whole number and n is said predetermined value.

10. The apparatus of claim 3, further comprising means for transmitting signals from said signal generating means to said expelling means in imitation of travel of the corresponding defective sheets from said scanner to said expelling means.

11. The apparatus of claim 10, wherein said signal transmitting means includes means for transmitting said signals from said signal generating means to said adjusting means.

12. The apparatus of claim 11, wherein said signal transmitting means comprises a shift register.

13. The apparatus of claim 3, further comprising means for preventing an adjustment of said severing means during severing of the web.

14. The apparatus of claim 3, wherein said preventing means comprises initiator means and means for synchronizing the operation of said initiator means with the frequency at which said severing means severs the web.

15. The apparatus of claim 14, wherein said initiator means is arranged to transmit signals at the frequency at which said severing means severs the web.

16. The apparatus of claim 3, further comprising means for transmitting signals from said signal generating means to said expelling means so that said expelling means expels x sheets in response to each signal, x being a whole number including one.

17. The apparatus of claim 3, wherein said severing means includes a rotary cross cutter and said adjusting means includes means for accelerating or decelerating said rotary cutter, and further comprising means for transmitting signals from said signal generating means to said adjusting means including a counter arranged to determine the extent of deviation of the angular position of said cutter for severing of a defective sheet from the angular position for severing sheets whose length matches said value.

18. The apparatus of claim 3, further comprising means for resetting said severing means to a predetermined starting position, particularly upon replacement of a first source of web with a second source.

19. The apparatus of claim 18, wherein said resetting means comprises manually operable switch means.

* * * * *